US005735356A

United States Patent [19]

Boulard

[11] Patent Number: 5,735,356

[45] Date of Patent: Apr. 7, 1998

[54] WELL BORING METHOD AND APPARATUS

[76] Inventor: Victor Boulard, 2862 Rue Valleyview Box 39, Blezard Valley, Ontario, Canada, P0M 1E0

[21] Appl. No.: 656,957

[22] Filed: Jun. 6, 1996

[51] Int. Cl.[6] ..... E21B 7/18; E21B 21/00

[52] U.S. Cl. ..... 175/21; 166/162; 166/222; 175/67

[58] Field of Search ..... 175/21, 67, 54; 166/56, 157, 158, 162, 222, 311, 312

[56] References Cited

U.S. PATENT DOCUMENTS

| | | | |
|---|---|---|---|
| 1,279,333 | 9/1918 | Green | 166/222 |
| 2,960,368 | 11/1960 | Watanabe | 37/323 |
| 3,556,597 | 1/1971 | Porter | 299/5 |
| 3,730,592 | 5/1973 | Wenneborg et al. | 299/17 |
| 4,111,262 | 9/1978 | Duncan | 166/162 X |

FOREIGN PATENT DOCUMENTS

| | | | |
|---|---|---|---|
| 730014 | 10/1993 | U.S.S.R. | 166/162 |

*Primary Examiner*—David J. Bagnell
*Attorney, Agent, or Firm*—Ridout & Maybee

[57] ABSTRACT

Apparatus is disclosed for removing soil from a well, which is particularly adapted for use both in cleaning out sandy deposits in pre-existing wells and in boring new well shafts through sandy ground, or through alternating hard and soft soil layers. The apparatus comprises a substantially cylindrical, hollow reservoir body tapered at the bottom end to form a drainage spout and open at the upper end. The reservoir body is lowered into the well liner toward the bottom of the well. A jet of water is introduced through a passageway in the reservoir to create a slurry wave which causes previously loosened soil inside the well liner to rise and overflow into the reservoir body, whereby the soil may then be removed from the well.

15 Claims, 3 Drawing Sheets

WELL BORING METHOD AND APPARATUS

FIELD OF THE INVENTION

The present invention is directed to a method and apparatus for removing soil from well-like cavities in the ground. The proposed method and apparatus are particularly adapted for use both in cleaning out sandy deposits in pre-existing wells, as well as for boring new well shafts through sandy ground, or through alternating hard and soft soil layers. The invention is also useful in removing some types of clay from well boreholes.

BACKGROUND OF THE INVENTION

Sinking narrow well shafts manually is often difficult, especially through loose sandy ground, because the shaft walls are unstable and can cave in, thereby frustrating vertical progress.

Where the well is being dug to the water table, additional difficulties arise. Below the preliminary sand layer, there is generally at least one compacted soil or hardpan layer which is difficult to breach due to lack of leverage in a narrow shaft.

In the case of pre-existing wells, especially those used for domestic water consumption, water seepage can cause a build-up of sand at the bottom of the well. Such a build-up can eventually clog the well, rendering it useless.

It is therefore an object of the present invention to provide a simple and inexpensive apparatus and method for removing sand deposits from well shafts and for boring new well shafts particularly through loose sandy soil or layered sand and hardpan ground.

SUMMARY OF THE INVENTION

Accordingly, the present invention is directed to providing a method for removing soil from a well consisting of lowering empty reservoir means into the well inside a well liner and jetting fluid into the liner into contact with soil at the bottom of the well thereby creating a slurry wave with the soil inside the liner rising to overflow into the reservoir means. The reservoir means may be removed from the well after at least a portion of the soil from the slurry wave has settled into it, and emptied. The liner may then be sunk further into the well.

According to the invention an apparatus for removing soil from a well is also provided, which consists of a reservoir body having at least one outer wall defining an open cavity, means for lowering the reservoir body into the well into proximity with the bottom of the well, and for removing the reservoir from the well without substantial spillage from the open cavity, communication means for transferring a jet of fluid into the well into contact with soil at the bottom of the well to create a slurry wave with the soil in the well, and containment means for directing the slurry wave to overflow into the reservoir body.

Preferably, the reservoir includes drainage means allowing fluid to drain from the cavity as the reservoir is raised from the well.

Preferably, the communication means comprise a passageway defined through the longitudinal axis of the reservoir body, which passageway is sealed from the cavity of the reservoir body.

DETAILED DESCRIPTION

Figure 2:
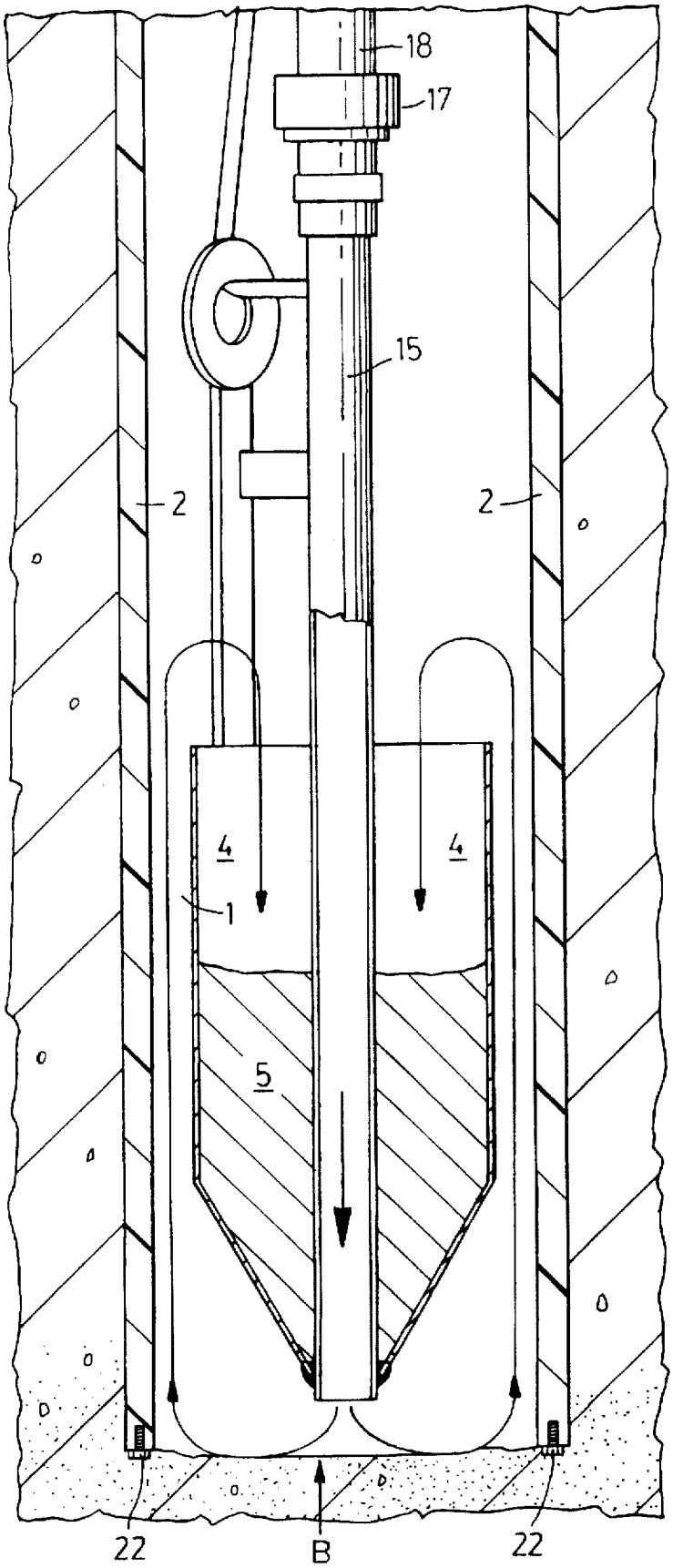
FIG. 2 is a cross-sectional view of the apparatus of FIG. 1.
Figure 3:
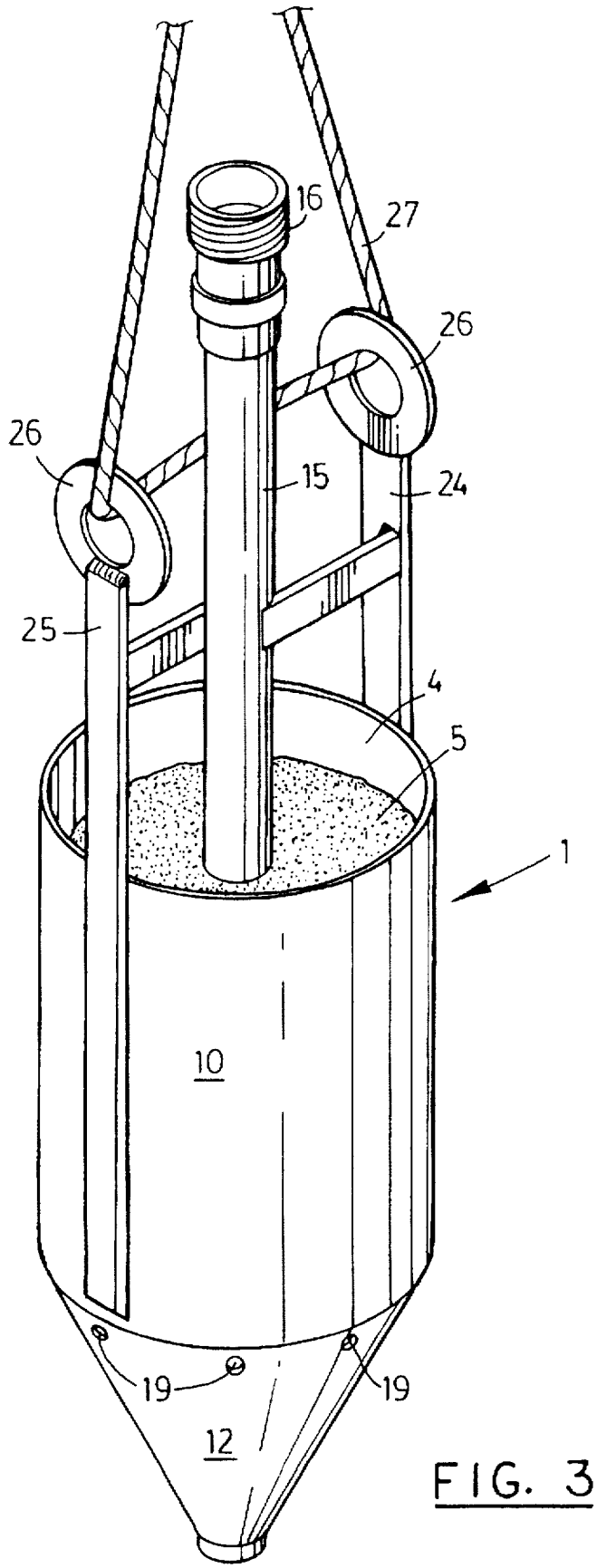
FIG. 3 is a perspective view of the reservoir means for removing soil from a well, according to the invention.

Referring now to the drawings, it can be seen that the apparatus for removing soil from a well comprises a reservoir 1 which can be lowered into a well liner 2 which has been inset into a preformed depression in the ground. The reservoir means 1 is lowered to the bottom 3 of the well depression, as shown in FIG. 2, and fluid (water) is jetted into the well into contact with loose soil at the bottom 3 of the well to form a slurry of soil and fluid. As shown by the directional arrows in FIG. 2, the slurry wave rises inside the liner 2 and overflows into the open cavity 4 of the reservoir 1. A quantity of soil will settle in the cavity 4 forming sediment 5, and can be removed from the well simply by raising the reservoir 1.

In the preferred embodiment illustrated, the reservoir 1 is in the form of a substantially cylindrical body 10, tapered at one end to form a bottom drainage spout 12. The cylindrical body 10 is open at its upper end and, as can be seen from FIG. 2, is hollow. The interior cavity 4 of the cylindrical body 1 is sealed at the spout end 2 of the cylindrical body 1 forming the reservoir cavity 4 for holding the soil sediment 5.

A rigid tube 15 extends through the middle of the reservoir 1 along its longitudinal axis, connecting with and communicating through the spout 12, but rigid tube 15 is sealed from the inner cavity 4 of the reservoir 1.

The rigid tube 15 includes a threaded end portion 16 for receiving the female threaded portion 17 of a hose 18 of a water delivery system, such as an ordinary garden hose. At or proximate to its tapered end, the reservoir 1 includes at least one drainage hole 19 formed through the wall of the cylindrical body 10 communicating with the cavity 4 to allow drainage of excess fluid seeping from the sediment 5 settled in the cavity 4. However, it should be pointed out that the drainage holes 19 are preferably sufficiently small to prevent leakage of any of the soil sediment 5 trapped in the reservoir cavity 4.

Figure 1:
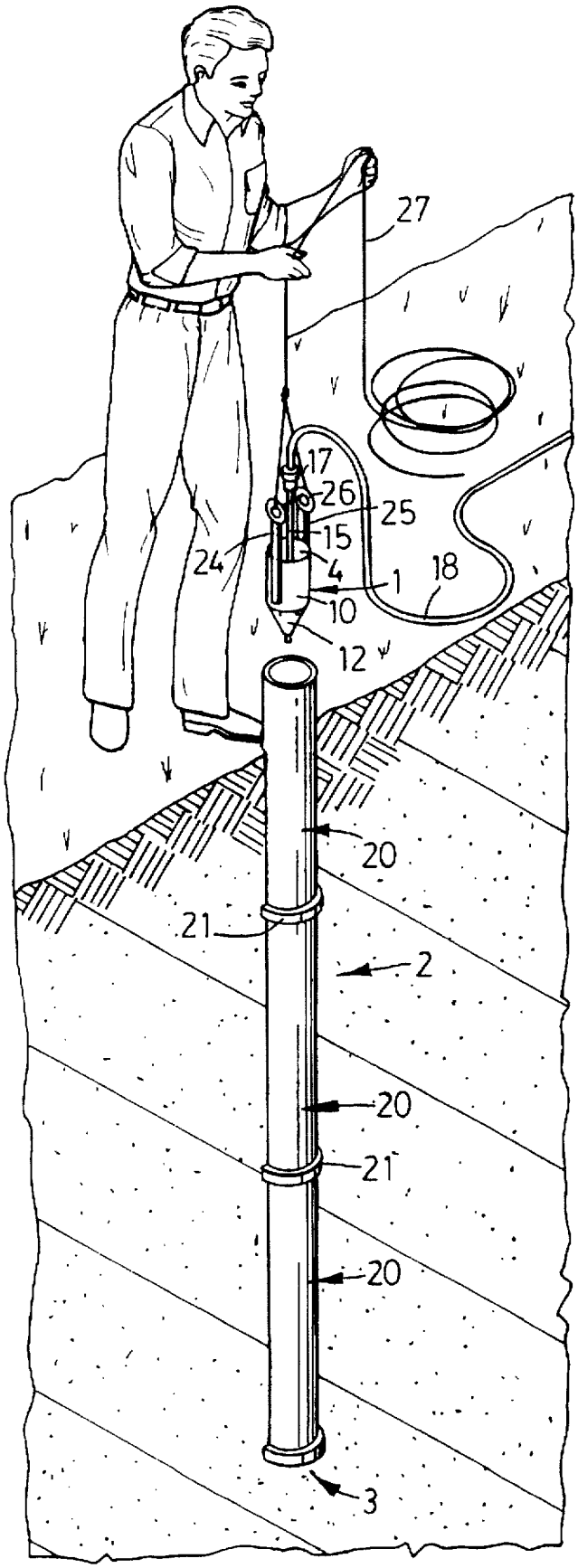
FIG. 1 is a perspective view of an apparatus for removing soil from a well, in use.

In operation, a rigid plastic liner tubing 20 of the type illustrated in FIGS. 1 and 2, may be sunk into the ground. The tubing may be of the type of four or six inch diameter rigid plastic tubing readily commercially available, but of sufficient diameter that the reservoir can slip freely, if with close clearance, through the tubing. For ease of use, the tubing may be used in 4 to 5 foot lengths with standard couplings, such as sleeve joints 21, joining each new length as needed.

Sinking the liner tubing 20 into a standing vertical position in the ground is generally accomplished by twisting the liner tubing in the well and forcibly causing it to stir up or loosen sand at the bottom of the well to permit the liner to sink, although at depths greater than about 15 to 20 feet it may be necessary to empty jacking means to sink the liner further into the ground as it becomes more difficult to twist the liner tubing. Several embodiments are described herein to facilitate the twisting and loosening action of the liner tubing 20.

One embodiment illustrated in FIG. 2, involves the addition of one or more scraping attachments protruding from the bottom end of the lowest length of tubing 20, for grating or loosening the hard packed soil or hardpan while the tubing is twisted under pressure in the well. It has been found that the protruding heads of self-tapping screws 22 sunk into the lower end of the plastic tubing are adequate scraping attachments for loosening hard packed sand. Knife blades imbedded in the bottom end of the tubing 20 could also be used, but are not needed if liner tubing is being jacked into the ground rather than twisted. In any event, it must be insured, if knife blades are used to loosen the packed sand, that the blades not cross the liner opening. In a further embodiment, not illustrated, there may be provided integral means for applying torque to the liner tubing. For this purpose a durable collar (of steel or like manufacture) with projecting arms may be tightly bound around the uppermost end of the liner tubing to facilitate twisting of the liner tubing in the ground manually by the projecting arms, or through use of a jack (not shown). It has been found that when using a jack to push the liner tubing 20 into the ground, the force provided by the jack yields sufficient pressure to loosen hard packed sand without the addition of scraping attachments.

Once the liner tubing 20 is in upright standing position sunk into the ground, the reservoir 1 may be lowered inside the tubing until it is in proximity with the loosened soil at the bottom 3 of the tube.

Elongated hitching means are provided included rigid supports 24 and 25 on each of which is mounted an annular ring 26 through which a rope 27 or similar connection may be threaded to allow the user to raise or lower the reservoir 1 inside the liner tubing 20.

After lowering the reservoir 1 into the liner tubing 20 in proximity with the sandy soil at the bottom of the well, a jet of water is introduced by the hose 18 through the rigid tube 15 and out of the bottom spout 12 into contact with the soil at the bottom of the well. The turbulence of the water jet loosens the upper layer of sand, forming a dispersion or slurry which rises quickly up the sides of the reservoir 1 inside the tubing 20, and overflows into the open cavity 4 of the reservoir 1.

The jet of water is preferably introduced in short blasts only, allowing the soil in slurry which has overflowed into the cavity 4 to settle and form sediment 5. Pressurized water blasts (in the range of 35 psi or more) has been found especially useful for dislodging and removing some types of heavy clay soil.

Once the reservoir 1 contains a quantity of soil, it may be raised from the well and emptied for reuse.

Modifications of the invention which do not materially affect the manner of use of my invention will be obvious to one skilled in the art, and such modifications are intended to be covered herein.

I claim:

1. A method of removing soil from a well, comprising:

lowering empty reservoir means to the bottom of the well inside a well liner;

jetting fluid into the liner into contact with soil at the bottom of the well thereby creating a slurry wave with the soil inside the liner rising to overflow into the reservoir means;

removing the reservoir means from the well after at least a portion of soil from the slurry wave has settled therein; and sinking the liner further into the well.

2. A method of removing soil from a well, according to claim 1, wherein the step of sinking a liner further into the well includes rotating the liner under pressure inside the well whereby to scrape up and loosen soil at the bottom of the well.

3. A method of removing soil from a well, comprising:

grating and loosening soil at the bottom of the well;

sinking a well liner into the well into contact with the bottom of the well;

lowering empty reservoir means to the bottom of the well inside the liner;

jetting pressurized fluid into the liner into contact with soil at the bottom of the well thereby creating a slurry wave with loosened soil inside the liner rising to over-flow into the reservoir means; and removing the reservoir means from the well after at least a portion of the soil from the slurry wave has settled therein.

4. Apparatus for removing soil from a well, comprising:

a reservoir body having at least one outer wall defining an open cavity, wherein fluid drainage means are formed through the outer wall communicating with the cavity of the reservoir body;

means for lowering the reservoir body into the well into proximity with the bottom of the well and for removing the reservoir body from the well without substantial spillage of material from the open cavity;

communication means for transferring a jet of fluid into the well into contact with soil at the bottom of the well, to create a slurry wave with said soil in the well; and containment means for directing said slurry wave to overflow into the open cavity of the reservoir body.

5. Apparatus for removing soil from a well, according to claim 4, wherein the reservoir body has a longitudinal axis defined therethrough and the communication means comprise a passageway disposed through the longitudinal axis of the reservoir body, which passageway is sealed from the open cavity of the reservoir body.

6. Apparatus for removing soil from a well, according to claim 5, wherein the passageway comprises a hose disposed through the reservoir body along its longitudinal axis.

7. Apparatus for removing soil from a well, according to claim 5, wherein the passageway is centrally disposed in the reservoir body.

8. Apparatus for removing soil from a well, according to claim 4, wherein the reservoir body is substantially cylindrical in shape tapered at one end to form a bottom drainage spout, which drainage spout is sealed from the open cavity.

9. Apparatus for removing soil from a well, according to claim 8, wherein the communication means incorporates the drainage spout.

10. Apparatus for removing soil from a well, according to claim 4, wherein the containment means further comprises scraping means for loosening soil at the bottom of the well.

11. Apparatus for removing soil from a well, according to claim 4, wherein the containment means comprises a tubular liner adapted to be placed vertically into the well and to receive the reservoir body freely lowered and raised therethrough.

12. Apparatus for removing soil from a well, according to claim 11, wherein the tubular liner is adapted to receive the reservoir body in close clearance therethrough.

13. Apparatus for removing soil from a well, according to claim 11, wherein the tubular liner further comprises at least one protrusion extending from the bottom of the liner and serving as scraping means for loosening soil at the bottom of the well.

14. Apparatus for removing soil from a well, according to claim 4, further comprising hitching means on the reservoir body adapted for receiving connecting means for lowering and raising the reservoir body in the well.

15. Apparatus for removing soil from a well, according to claim 4, further comprising a source of pressurized fluid connected to the communication means, whereby to create a turbulent slurry wave with soil at the bottom of the well.

* * * * *